US007183477B2

(12) United States Patent
Nishitani et al.

(10) Patent No.: US 7,183,477 B2
(45) Date of Patent: Feb. 27, 2007

(54) MUSICAL TONE CONTROL SYSTEM AND MUSICAL TONE CONTROL APPARATUS

(75) Inventors: Yoshiki Nishitani, Hamakita (JP); Satoshi Usa, Hamamatsu (JP); Eiko Kobayashi, Hamakita (JP); Akira Miki, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/145,462

(22) Filed: May 14, 2002

(65) Prior Publication Data

US 2002/0170413 A1 Nov. 21, 2002

(30) Foreign Application Priority Data

May 15, 2001 (JP) ..... 2001-145336

(51) Int. Cl.
*G10H 1/18* (2006.01)

(52) U.S. Cl. ..... 84/600; 84/601; 84/602

(58) Field of Classification Search ..... 84/600–609, 84/614, 615, 645, 628, 653, 643
See application file for complete search history.

(56) References Cited

U.S. PATENT DOCUMENTS 5,027,688 A 7/1991 Suzuki et al.
5,046,394 A 9/1991 Suzuki et al.
5,058,480 A 10/1991 Suzuki et al.
5,177,311 A 1/1993 Suzuki et al.
5,192,823 A * 3/1993 Suzuki et al. ..... 84/600
5,290,964 A 3/1994 Hiyoshi et al.
5,313,010 A 5/1994 Matsushima et al.
5,488,196 A * 1/1996 Zimmerman et al. ..... 84/612
5,512,703 A 4/1996 Usa
5,585,584 A 12/1996 Usa
5,648,627 A 7/1997 Usa (Continued)

FOREIGN PATENT DOCUMENTS

JP 09-127937 5/1997

OTHER PUBLICATIONS

Sonification Report: Status of the Field and Research Agenda. G. Kramer, B. Walker; eds. 1997. Prepared for NSF.*

(Continued)

*Primary Examiner*—Lincoln Donovan
*Assistant Examiner*—David S. Warren
(74) *Attorney, Agent, or Firm*—Harness, Dickey & Pierce, P.L.C.

(57) ABSTRACT

There is provided a musical tone control system capable of controlling the generation of musical tones in a manner reflecting only motion or physical posture suitable for the musical tone generation control when controlling the generation of musical tones reflecting motions of a plurality of users or a plurality of body parts thereof or physical posture thereof. A plurality of motion detecting devices capable of being carried by operators detect motions of the users or operators carrying the devices, and transmit detected motion signals indicative of the detected motions. A receiver device receives the detected motion signals transmitted from the plurality of motion detecting devices. A CPU control extracts at least one detected motion signal satisfying a predetermined condition from the detected motion signals received by the receiver device and controls musical tones to be generated, based on the extracted at least one detected motion signal.

20 Claims, 8 Drawing Sheets

U.S. PATENT DOCUMENTS

| | | | | |
|---|---|---|---|---|
| 5,663,514 | A | 9/1997 | Usa | |
| 5,808,224 | A * | 9/1998 | Kato | 84/609 |
| 5,920,024 | A * | 7/1999 | Moore | 84/609 |
| 6,198,034 | B1 * | 3/2001 | Beach et al. | 84/600 |
| 2001/0015123 | A1 | 8/2001 | Nishitani et al. | |
| 2002/0055383 | A1 * | 5/2002 | Onda et al. | 463/36 |

OTHER PUBLICATIONS

Atmospherics/Weather Works: A Multi-Channel Storm Sonification Project. A. Polli. 2004.*

* cited by examiner 3
4
22
23
24
25
26
RADIO RECEIVER
INFORMATION EXTRACTION & ANALYSIS SECTION
PERFORMANCE PARAMETER DETERMINING SECTION
MUSICAL TONE GENERATING SECTION
SOUND SPEAKER SYSTEM
U1
U2
Un
5-1
5-2
5-n
RADIO TRANSMITTER
MOTION SENSOR
20
MS

MUSICAL TONE CONTROL SYSTEM AND MUSICAL TONE CONTROL APPARATUS

BACKGROUND OF THE INVENTION

1. Field of the Invention

The present invention relates to a musical tone control system and a musical tone control apparatus, which control musical tone generation in a manner reflecting motions or physical postures of users.

2. Description of the Related Art

Audio systems and other musical tone generating apparatuses can generate desired musical tones once four performance parameters of tone color, pitch, volume, and effects are determined. MIDI (Musical Instrument Digital Interface) musical instruments and other musical tone generating apparatuses perform music based on music data. Users adjust the volume and other performance parameters by knobs, buttons, etc. of the MIDI musical instruments.

As described above, in MIDI musical instruments and other musical tone generating apparatuses, the desired volume etc. are obtained by the user suitably operating knobs or other operating elements. When a user listens to music performed by a musical tone generating apparatus at a desired volume etc., the method of adjustment of the performance parameters by control knobs is effective. In the conventional musical tone generating apparatuses, however, while it is possible to provide the user with performance or reproduction fidelity of music based on music data, it is not possible to provide the user with the pleasure of actively participating in the reproduction of the music.

Therefore, a system may be considered in which motion sensors are attached to one or more parts of the body of the user, movement of the body of the user is detected by these sensors, and music is played based on the results of the detection. By using such a system, it is possible to control the performance of music based on MIDI data etc. in accordance with motion of the user rather than having the user dance or otherwise move in accordance with the music and to thereby provide the user with a new form of participatory musical entertainment. Especially, it can be considered that if such motion sensors are attached to parts of a plurality of users and generation of musical tones is controlled in playing a musical composition in a manner reflecting motions of the users, musical entertainment with enhanced pleasure can be provided.

In such a system in which motions of a plurality of users are detected and music is performed in accordance with a plurality of detection results, however, if musical tone generation control is carried out in accordance with motions of all the users in a state where one user stops moving due to fatigue or the like while the other users are moving, it results in that the motion (no motion) of the user stopping moving is reflected upon the performance of music. Also, if the motion of one user largely departs from those of the other users, the departing motion of the user is reflected upon the performance of music, and thus performance of music intended by the other users cannot be carried out.

SUMMARY OF THE INVENTION

It is an object of the present invention to provide a musical tone control system and a musical tone control apparatus which are capable of controlling the generation of musical tones in a manner reflecting only motion or physical posture suitable for the musical tone generation control when controlling the generation of musical tones reflecting motions of a plurality of users or a plurality of body parts thereof or physical posture thereof.

To attain the above object, in a first aspect of the present invention, there is provided a musical tone control system comprising a plurality of motion detecting devices capable of being carried by operators, the motion detecting devices detecting motions of the operators carrying the devices, and transmitting detected motion signals indicative of the detected motions, a receiver device that receives the detected motion signals transmitted from the plurality of motion detecting devices, and a control device that extracts at least one detected motion signal satisfying a predetermined condition from the detected motion signals received by the receiver device and controls musical tones to be generated, based on the extracted at least one detected motion signal.

According to the first aspect of the present invention, a plurality of motion detecting terminals detect motions of a plurality of operators carrying the terminals and transmit detected motion signals indicative of the detected motions to a receiver device. A control device extracts at least one detected motion signal satisfying a predetermined condition from the detected motion signals received by the receiver device, and carries out musical tone generation control based only on the extracted at least one detected motion signal. As a result, motion(s) of operator(s) that are not suitable for the musical tone generation control can be precluded from being applied to the musical tone generation control.

In a preferred form of the first aspect of the present invention, the control device extracts at least one detected motion signal indicative of at least one motion lying within a predetermined range of contents of motion from the detected motion signals received by the receiver device.

Preferably, the control device extracts a predetermined number of detected motion signals indicative of detected motions close to a predetermined motion in order of closeness from the detected motion signals received by the receiver device.

More preferably, the musical tone control system according to the first aspect of the present invention further comprises a transmitter device that transmits information for notifying that the at least one detected motion signal has been extracted, to at least one corresponding one of the motion detecting terminals.

To attain the above object, in a second aspect of the present invention, there is provided a musical tone control system comprising a plurality of human body state detecting devices capable of being carried by operators, the human body state detecting devices detecting body states of the operators carrying the devices, and transmitting detected human body state signals indicative of the detected body states, a receiver device that receives the detected human body state signals transmitted from the plurality of human body state detecting devices, and a control device that extracts at least one detected human body state signal satisfying a predetermined condition from the detected human body state signals received by the receiver device and controls musical tones to be generated, based on the extracted at least one detected human body state signal.

To attain the above object, in a third aspect of the present invention, there is provided a musical tone control apparatus comprising a receiver device that receives a plurality of detected motion signals corresponding to motions of a plurality of operators, and a control device that extracts at least one detected motion signal satisfying a predetermined condition from the detected motion signals received by the receiver device and controls musical tones to be generated, based on the extracted at least one detected motion signal.

The above and other objects, features and advantages of the invention will become more apparent from the following detailed description taken in conjunction with the accompanying drawings.

DESCRIPTION OF THE PREFERRED EMBODIMENTS

Preferred embodiments of the present invention will now be described in detail with reference to the accompanying drawings.

Figure 1:
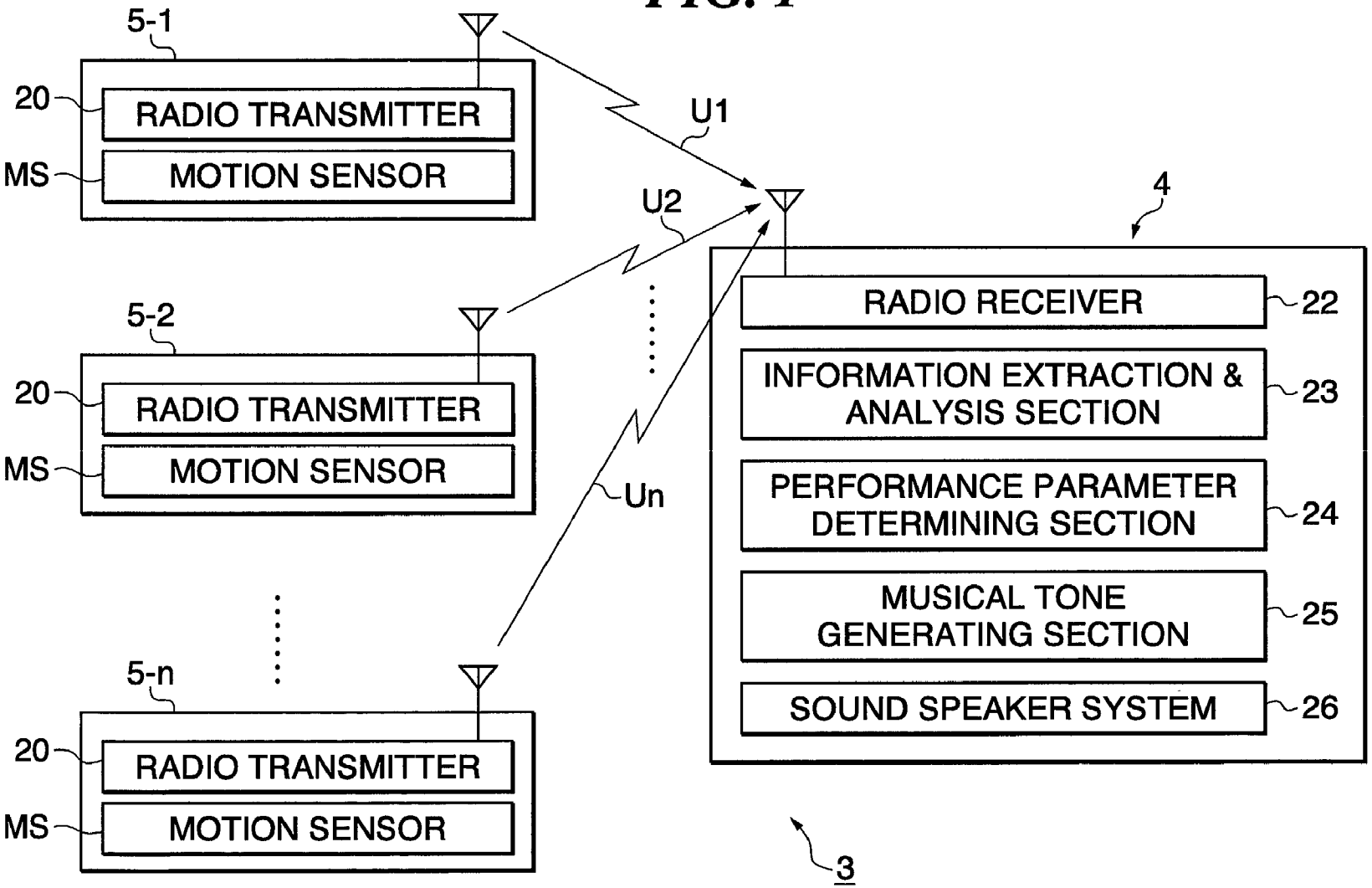
FIG. 1 is a block diagram of the schematic configuration of functions of a musical tone generating system according to an embodiment of the present invention.

FIG. 1 is a view of the schematic functional configuration of a musical tone generating system according to an embodiment of the present invention. As shown in the figure, the musical tone generating system (musical tone control system) 3 is provided with a musical tone generating apparatus 4 and a plurality of (n) motion detecting terminals 5-1 to **5-*n***.

Each of the plurality of motion detecting terminals 5-1 to **5-*n* is a portable terminal which can be carried by a user, for example, held in the hand by the user or attached to part of his or her body. Each of the plurality of motion detecting terminals 5-1 to 5-*n*** is carried by the user when used, and is provided with a motion sensor MS for detecting the motion of the user carrying it. Here, as the motion sensor MS, it is possible to use a three-dimensional acceleration sensor, a three-dimensional velocity sensor, a two-dimensional acceleration sensor, a two-dimensional velocity sensor, a strain detector, or various other known motion sensors.

Each of the plurality of motion detecting terminals 5-1 to **5-*n* carries a radio transmitter 20 for radio transmitting data to the musical tone generating apparatus 4. The radio transmitters 20 sequentially radio transmits signals U1-Un indicative of detected motions (detected motion signals) corresponding to motions of the associated users generated by the associated motion sensors MS in the above way to the musical tone generating apparatus 4. To discriminate which of the detected motion signals U1–Un corresponds to which of the motion detecting terminals 5-1 to 5-*n*, the radio transmitters 20** assign ID numbers to the respective detected motion signals when transmitting them.

The motion detecting terminals 5-1 to **5-*n* may be carried by respective different operators, or a plurality of such motion detecting terminals may be attached to respective different parts of the body of a single operator (for example, left and right hands and legs). In the case where the plurality of motion detecting terminals are attached to respective different body parts of a single operator, only the motion sensors MS may be attached to the different body parts and detected motion signals from the motion sensors MS may be collectively transmitted from one of the radio transmitters 20 to the musical tone generating apparatus 4. In this case, to enable the musical tone generating apparatus 4 to discriminate between the detected motion signals from the motion sensors MS, it is necessary for the radio transmitters 20** to assign to the respective detected motion signals headers or the like indicative of the respective sensor detection results.

The musical tone generating apparatus 4 is comprised of a radio receiver 22, an information extraction and analysis section 23, a performance parameter determining section 24, a musical tone generating section 25, and a sound speaker system 26.

The radio receiver 22 receives the detected motion signals U1 to Un radio transmitted from the motion detecting terminals 5-1 to **5*n* and outputs the received detected motion signals to the information extraction and analysis section 23. The information extraction and analysis section 23 performs predetermined analysis processing on the detected motion signals U1 to Un supplied from the radio receiver 22, extracts only results of analysis matching a predetermined condition from among the detected motion signals U to Un and outputs the extracted results of analysis to the performance parameter determining section 24**.

The performance parameter determining section 24 determines and sets performance parameters for musical tones in accordance with the results of analysis of the detected motion signals supplied from the information extraction and analysis section 23, for example, the volume, tempo, tone color, and other parameters of the musical tones.

The musical tone generating section 25 generates a musical tone signal based on music data (for example, MIDI data) stored in advance. When generating such musical tone signal, the musical tone generating section 25 generates the musical tone signal in accordance with the performance parameters of the musical tones determined by the performance parameter determining section 24 and outputs the generated musical tone signal to the sound speaker system 26. The sound speaker system 26 outputs musical tones in accordance with the generated musical tone signal supplied from the musical tone generating section 25 to thereby perform music.

By being provided with the above functions, the musical tone generating system 3 can perform original music reflecting the motions of the users carrying the motion detecting terminals 5-1 to **5-*n*** rather than simply performing or reproducing music faithful to music data.

Figure 2:
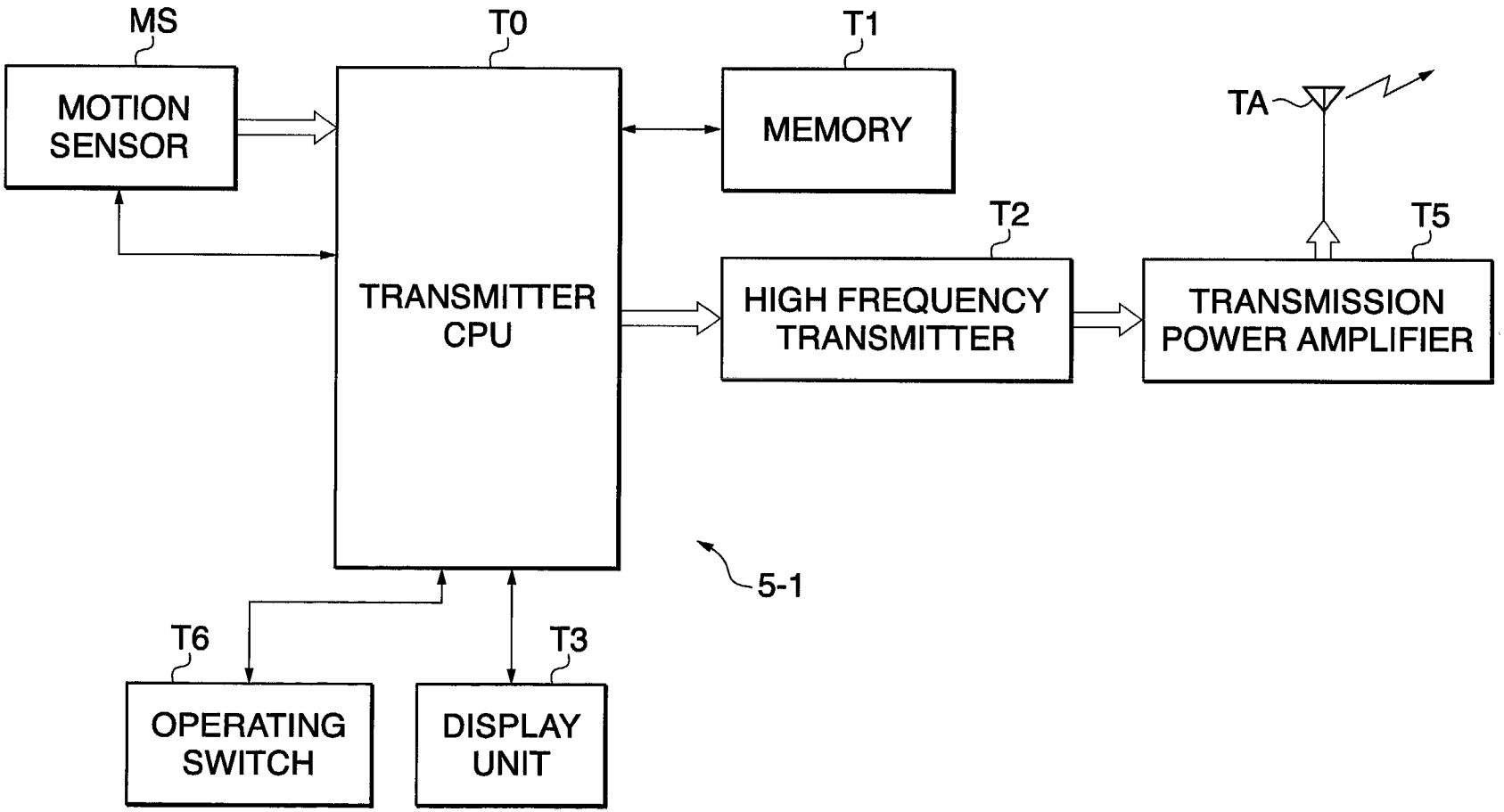
FIG. 2 is a block diagram of an example of the hardware configuration of one of motion detecting terminals appearing in FIG. 1.

FIG. 2 is a block diagram of an example of the hardware configuration of the motion detecting terminal 5-1 in FIG. 1. The other motion detecting terminals 5-2 to **5-*n* are identical in configuration with the motion detecting terminal 5-1, and therefore the following description refers only to the motion detecting terminal 5-1**.

As shown in FIG. 2, the motion detecting terminal 5-1 is provided with a signal processor and a transmitter in addition to the motion sensor MS. The signal processor and transmitter are comprised of a transmitter central processing unit (transmitter CPU) T0, memory T1, high frequency transmitter T2, display unit T3, transmission power amplifier T5, operating switch T6, etc. The motion sensor MS is structured to enable it to be held by the play participant, that is, the user, in the hand or be attached to any location of the body of the user. Details of an example of the appearance and structure will be described later. For example, when making the motion sensor MS a hand held type, the signal processor and transmitter can be built into the sensor housing together with the motion sensor MS (see FIG. 3).

The transmitter CPU T0 controls the motion sensor MS, high frequency transmitter T2, and display unit T3 based on a transmitter operation program stored in the memory T1. The detected motion signal from the motion sensor MS is subjected to predetermined processing such as processing for assignment of an ID number by the transmitter CPU T0, is transmitted to the high frequency transmission T2, is amplified by the transmission power amplifier T5, and then is radio transmitted to the musical tone generating apparatus 4*a* side through a transmission antenna TA. That is, the transmitter CPU T0, memory T1, high frequency transmitter T2, transmission power amplifier T5, and transmission antenna TA form the radio transmitter 20 shown in FIG. 1.

The display unit T3 is for example provided with a seven-segment type light emitting diode (LED) or liquid crystal display (LCD) or one or more LED lights and displays various information such as the sensor number, operation on/off state, and power alarm. The operating switch T6 is used for turning the power of the motion detecting terminal 5 on and off, setting the mode, and other settings. These parts are supplied with drive power from a battery power unit, not shown. As this battery power unit, it is possible to use a primary cell or to use a rechargeable secondary cell.

Figure 3:
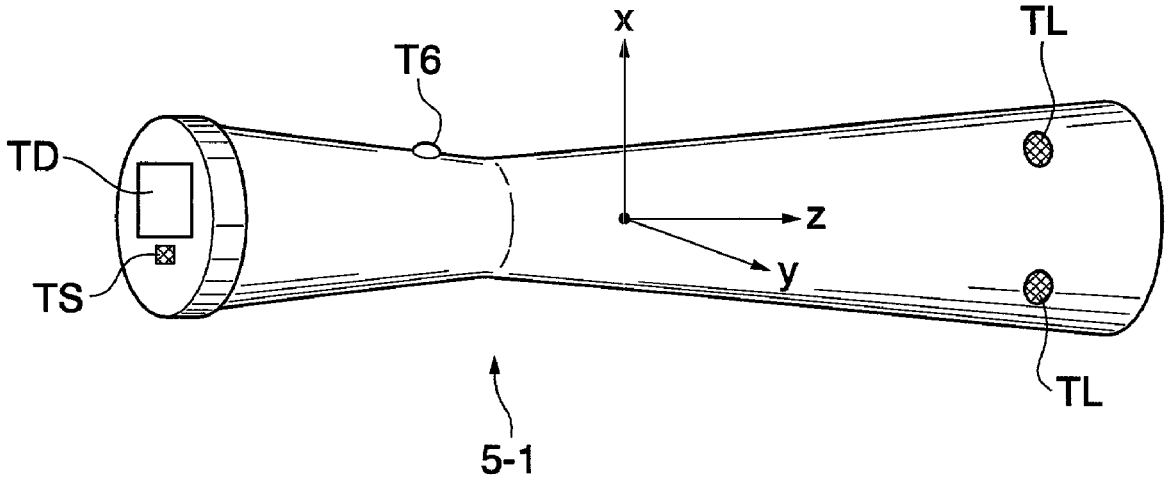
FIG. 3 is a view of the appearance of one of the motion detecting terminals appearing in FIG. 1.

FIG. 3 is a view of an example of the appearance of the motion detecting terminal 5-1. The motion detecting terminal 5-1 shown in FIG. 3 is a baton-shaped hand held type. The motion detecting terminal 5-1 houses the various parts shown in FIG. 2 except for the operation section and the display unit. As the built-in motion sensor MS, for example, a three-dimensional acceleration sensor, three-dimensional velocity sensor, or other three-dimensional sensor can be used. By the play participant holding and operating this motion detecting terminal 5-1, it is possible to output a detected motion signal corresponding to the direction, magnitude, and speed of the operation.

As shown in FIG. 3, the motion detecting terminal 5-1 has a larger diameter at the two ends and is tapered with a smaller diameter at the center and consists of a base part (illustrated at the left) and an end part (illustrated at the right). The base part has an average diameter smaller than the end part and can be easily gripped by the hand to function as a grip. At the outer surface of the bottom (left end in illustration) are provided an LED display TD of the display unit T3 and a power switch TS of the battery power source. At the outer surface of the center, an operating switch T6 is provided. Near the front end of the end part are provided a plurality of LED lights of the display unit T3.

The baton-shaped motion detecting terminal 5 shown in FIG. 3 outputs a signal corresponding to the direction of operation and operating force from the built-in motion sensor MS when the play participant holds the handle of the baton and operates it. For example, when a three-dimensional acceleration sensor as the motion sensor MS is built in the terminal with its x-axis direction detection axis aligned with the direction of attachment of the operating switch T6, if the motion detecting terminal 5-1 is held with the attachment position of the operating switch T6 up and swung up and down, an output signal indicating the x-axis direction acceleration $\alpha x$ corresponding to the swing acceleration (force) is generated. If the motion detecting terminal 5-1 is swung left and right (direction perpendicular to the paper surface), an output signal indicating the y-axis direction acceleration $\alpha y$ corresponding to the swing acceleration (force) is generated. If the motion detecting terminal 5-1 is thrust forward or pulled back (left-right direction of paper surface), an output signal indicating the z-axis direction acceleration $\alpha z$ corresponding to the thrust acceleration or pullback acceleration is generated. Such generated output signals, that is, detected motion signals, are transmitted to the musical tone generating apparatus 4 by the above radio transmission function.

Figure 4:
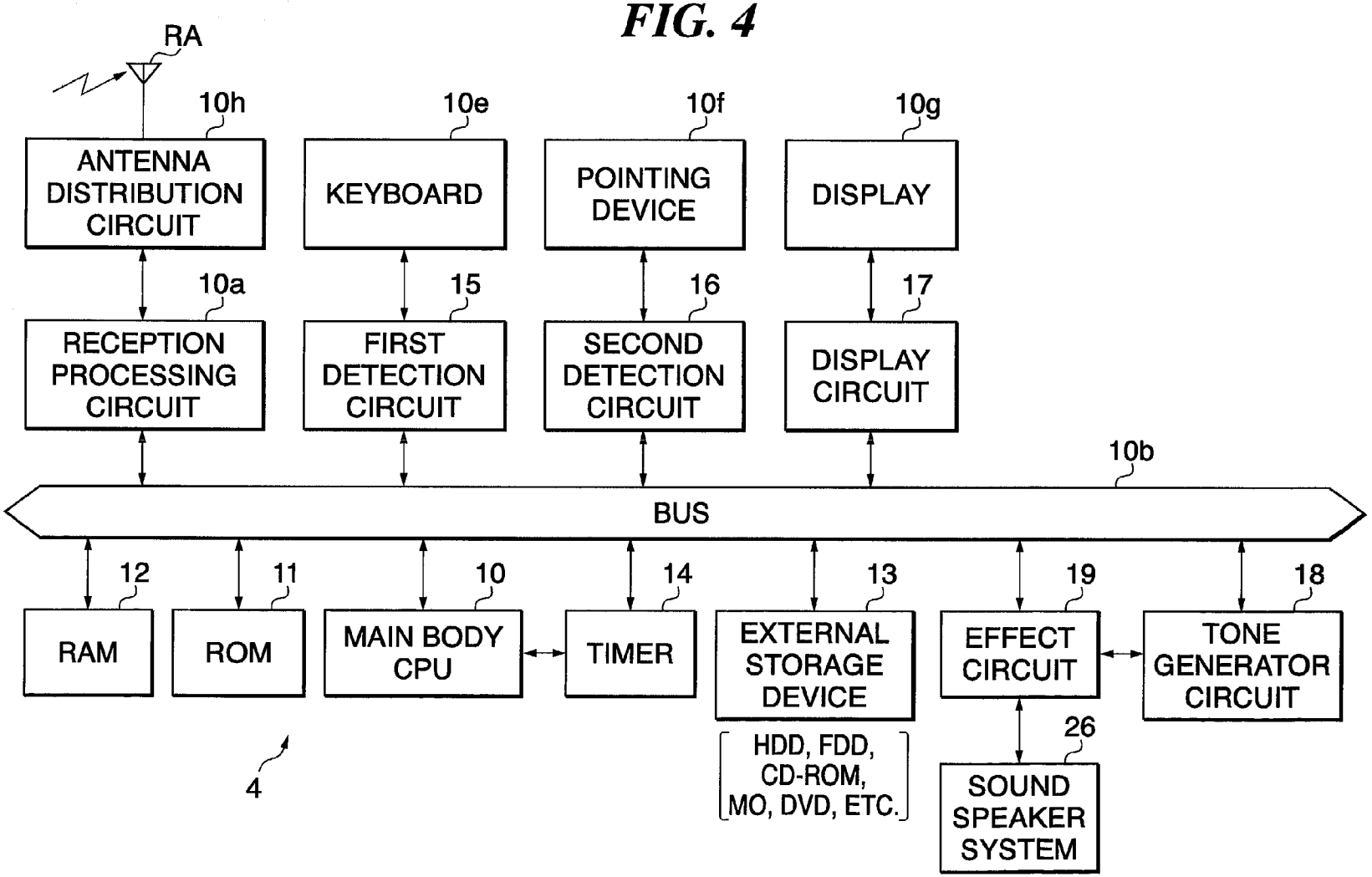
FIG. 4 is a block diagram of an example of the hardware configuration of a musical tone generating apparatus appearing in FIG. 1.

FIG. 4 is a block diagram of an example of the hardware configuration of the musical tone generating apparatus 4. As shown in FIG. 4, the musical tone generating apparatus 4 is comprised of a main body central processing unit (main body CPU) 10, a read only memory (ROM) 11, a random access memory (RAM) 12, an external storage device 13, a timer 14, first and second detection circuits 15 and 16, a display circuit 17, a tone generator circuit 18, an effect circuit 19, a reception processing circuit 10*a*, etc. These parts 10 to 10*a* are connected through a bus 10*b*.

The main body CPU 10 that controls the musical tone generating apparatus 4 as a whole performs various control in accordance with predetermined programs under the time control of the timer 14 used for generating a tempo clock or interruption clock. The CPU 10 centrally executes performance processing control programs relating to extraction of detected motion signals transmitted from the plurality of motion detecting terminals 5-1 to 5-*n*, determination of performance parameters, change of performance data, and control of reproduction. The ROM 11 stores predetermined control programs for controlling the musical tone generating apparatus 4. These control programs contain performance processing programs relating to extraction of detected motion signals, determination of performance parameters, change of performance data, and control of reproduction, various data/tables, etc. The RAM 12 is used as a work area for storing data or parameters needed for such processing and temporarily storing various data being processed.

A keyboard 10*e* is connected to the first detection circuit 15, a mouse or other pointing device 10*f* is connected to the second detection circuit 16, and a display 10*g* is connected to the display circuit 17. The keyboard 10*e* or pointing device 10*f* may be operated while the operator views various screens displayed on the display 10*g* so as to set various modes required for control of the performance data at the musical tone generating apparatus 4, assign processing or functions corresponding to ID numbers identifying the plurality of motion detecting terminals 5-1 to 5-*n*, and set tone colors (sound source) and various other settings for the performance tracks.

An antenna distribution circuit 10*h* is connected to the reception processing circuit 10*a*. The antenna distribution circuit 10*h* is for example comprised of a multichannel high frequency receiver and receives detected motion signals radio transmitted from the plurality of motion detecting terminals 5-1 to 5-*n* through a reception antenna RA. The reception processing circuit 10*a* converts the received signals to data that can be processed by the musical tone generating apparatus 4, introduces it into the apparatus, and stores it in a predetermined area of the RAM 12. That is, the reception processing circuit 10*a*, the antenna distribution circuit 10*h*, and reception antenna RA form the radio receiver 22 shown in FIG. 1.

The main body CPU 10 performs processing for play or performance in accordance with the above-mentioned control programs, analyzes the detected motion signals indicating the physical motions of the users holding the motion detecting terminals 5-1 to 5-*n*, and determines the performance parameters based on the results of the analysis corresponding to detected motion signal(s) matching the predetermined condition. That is, the main body CPU 10 etc. form the information extraction and analysis section 23 and the performance parameter determining section 24 shown in FIG. 1. Note that details of the processing for extracting detected motion signals and determining the performance parameters will be described later.

The effect circuit 19 formed by a digital signal processor (DSP) etc. realizes the functions of the musical tone generating section 25 shown in FIG. 1 together with the tone generator circuit 18 and main body CPU 10 and generates performance data processed in accordance with motions of the play participants holding the motion detecting terminals 5-1 to 5-*n* by control of the performance data based on the determined performance parameters. The sound speaker system 26 outputs the musical tones played in accordance with the musical tone signal based on the processed performance data.

The external storage device 13 is comprised of a hard disk drive (HDD), compact disk read-only memory (CD-ROM) drive, floppy disk drive (FDD), magneto-optic (MO) disk drive, digital versatile disk (DVD) drive, or other storage device and can store various types of data such as various control programs or music data. Therefore, it is possible to read the programs or various data etc. required for extraction of detected motion signals, determination of performance parameters, change of performance data, and control of reproduction not only using the ROM 11, but also from the external storage device 13 to the RAM 12 and if necessary store the processing results in the external storage device 13.

As described above, in the musical tone generating system 3, the information extraction and analysis section 23 performs predetermined processing for analysis of the detected motion signals from the motion detecting terminals 5-1 to 5-*n* received by the radio receiver 22, while the performance parameter determining section 24 determines the performance parameters based on the results of analysis. Here, how the detected motion signals should be analyzed, which of the detected motion signals should be the object for which the results of analysis should be how the results of analysis should be used for determination of performance parameters may be decided arbitrarily. These may be suitably set in accordance with the shape and type of the motion detecting terminals 5-1 to 5-*n* used (baton-shaped type or type attached to leg etc.), the type of the motion sensors MS carried by the motion detecting terminals 5-1 to 5-*n* (two-dimensional sensor or three-dimensional sensor), etc. Below, however, a description will be given of the example of processing for analysis and extraction and processing for determination of parameters when using three-dimensional sensors as the motion sensors MS.

Figure 5:
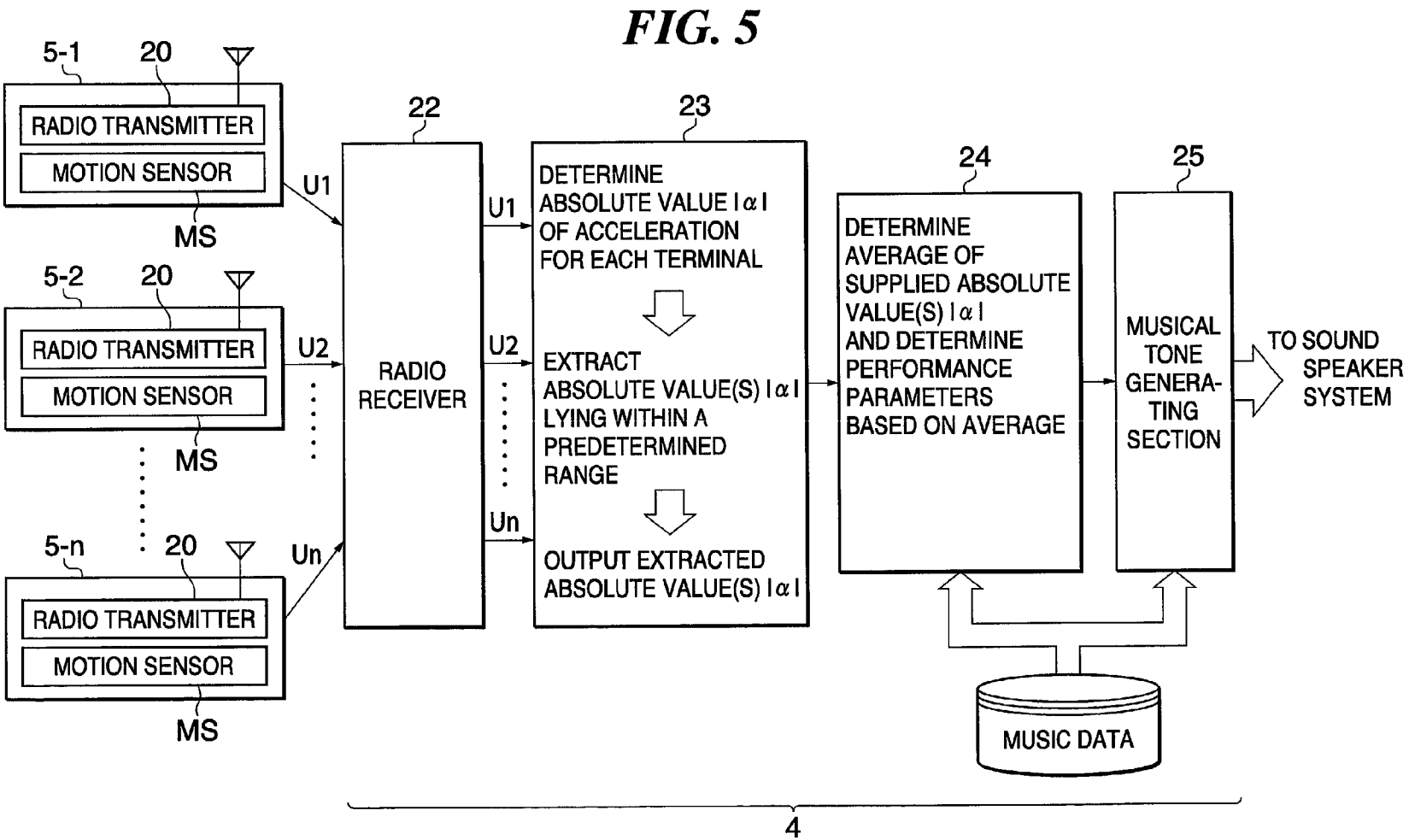
FIG. 5 is a view useful in explaining an example of processing for extraction and analysis and processing for determining parameters according to the musical tone generating system of FIG. 1.

FIG. 5 is a block diagram of an example of the analysis and extraction processing and the parameter determining processing. By referring to FIG. 5, a description will be given of the case where the volume of music performance based on MIDI data prepared in advance is controlled in accordance with detected motion signals supplied from the motion sensors MS (here, three-dimensional sensors) of the pluraility of motion detecting terminals 5-1 to 5-*n*.

Here, when the motion detecting terminals 5-1 to 5-*n* having mounted thereon three-dimensional sensors as the motion sensors MS are used, detected motion signals Mx, My, and Mz indicating the x-axis (vertical) direction acceleration $\alpha x$, y-axis (left-right) direction acceleration $\alpha y$, and z-axis (front-back) direction acceleration $\alpha z$ are radio transmitted from the x-axis detector SX, y-axis detector SY, and z-axis detector SZ of the motion sensor MS of each of the motion detecting terminals 5-1 to 5-*n* to the musical tone generating apparatus 4 with ID numbers of the motion detecting terminal 5-1 to motion detecting terminal 5-*n* assigned to the signals Mx, My, and Mz, respectively. When the musical tone generating apparatus 4 confirms that preset ID numbers have been assigned to these detected motion signals, data indicative of acceleration along the respective axes contained in the detected motion signals are output to the information extraction and analyzer 23 through the radio receiver 22.

The information extraction and analysis section 23 analyzes the acceleration data for each axis contained in the detected motion signals U1 to Un. It first finds the absolute value $|\alpha|$ of the acceleration expressed by formula (1), for each of the motion detecting terminals 5-1 to 5*n:*

$$|\alpha|=(\alpha x*\alpha x+\alpha y*\alpha y+\alpha z*\alpha z)^{1/2} \quad (1)$$

The information extraction and analysis section 23 determines whether or not the absolute value $|\alpha|$ of the acceleration determined based on the results of motion detection from the motion detecting terminals 5-1 to 5-*n* lies within a predetermined range. The information extraction and analysis section 23 extracts only the absolute values $|\alpha|$ of acceleration lying within the predetermined range, and outputs only the extracted absolute values $|\alpha|$ of acceleration to the performance parameter determining section 24. Here, the predetermined range of the absolute value $|\alpha|$ should be set so as to satisfy the relationship of $\alpha s<$absolute value $|\alpha|<\alpha b$ provided that $\alpha s$ represents the absolute value of acceleration that is determined based on results of detection by the motion sensor MS when the motion detecting terminal is almost stationary, and $\alpha b$ represents the absolute value of acceleration that is determined based on results of detection by the motion sensor MS when the motion detecting terminal is moved by a large amount and quickly. If the predetermined range is set to such a range, only the absolute values $|\alpha|$ of acceleration determined from results of motion detection of motion detecting terminals other than a motion detecting terminal held by an operator who is almost stationary and a motion detecting terminal held by an operator who is moving by a large amount and quickly can be extracted.

The performance parameter determining section 24 is supplied with only the absolute values $|\alpha|$ of acceleration extracted by the information extraction and analysis section 23 as noted above, and calculates an average value of the supplied absolute values $|\alpha|$. The performance parameter determining section 24 determines a performance parameter such that musical tone generation is carried out with a volume based on the calculated average value, and outputs the determined performance parameter to the musical tone generating section 25.

The musical tone generating section 25 generates a musical tone signal according to music data (MIDI data, for example) which is stored in advance, carries out amplitude modulation processing on the generated musical tone signal according to the performance parameter for controlling volume supplied from the performance parameter determining section 24, and outputs the musical tone signal thus adjusted to the sound speaker system 26. Consequently, the sound speaker system 26 carries out music performance based on music data such as MIDI data with a volume according to the performance parameter determined by the performance parameter determining section 24.

Although in the above example of processing, the average value of the acceleration absolute values $|\alpha|$ extracted by the information extraction and analysis section 23 is used for control of the volume, the average value of the extracted acceleration absolute values $|\alpha|$ may be used for control of the tempo of music performance based on MIDI data or the like. In this case, a control manner may be employed such that as the average value of the extracted acceleration absolute values $|\alpha|$ is larger, the performance tempo is made quicker, for example.

Figure 6:
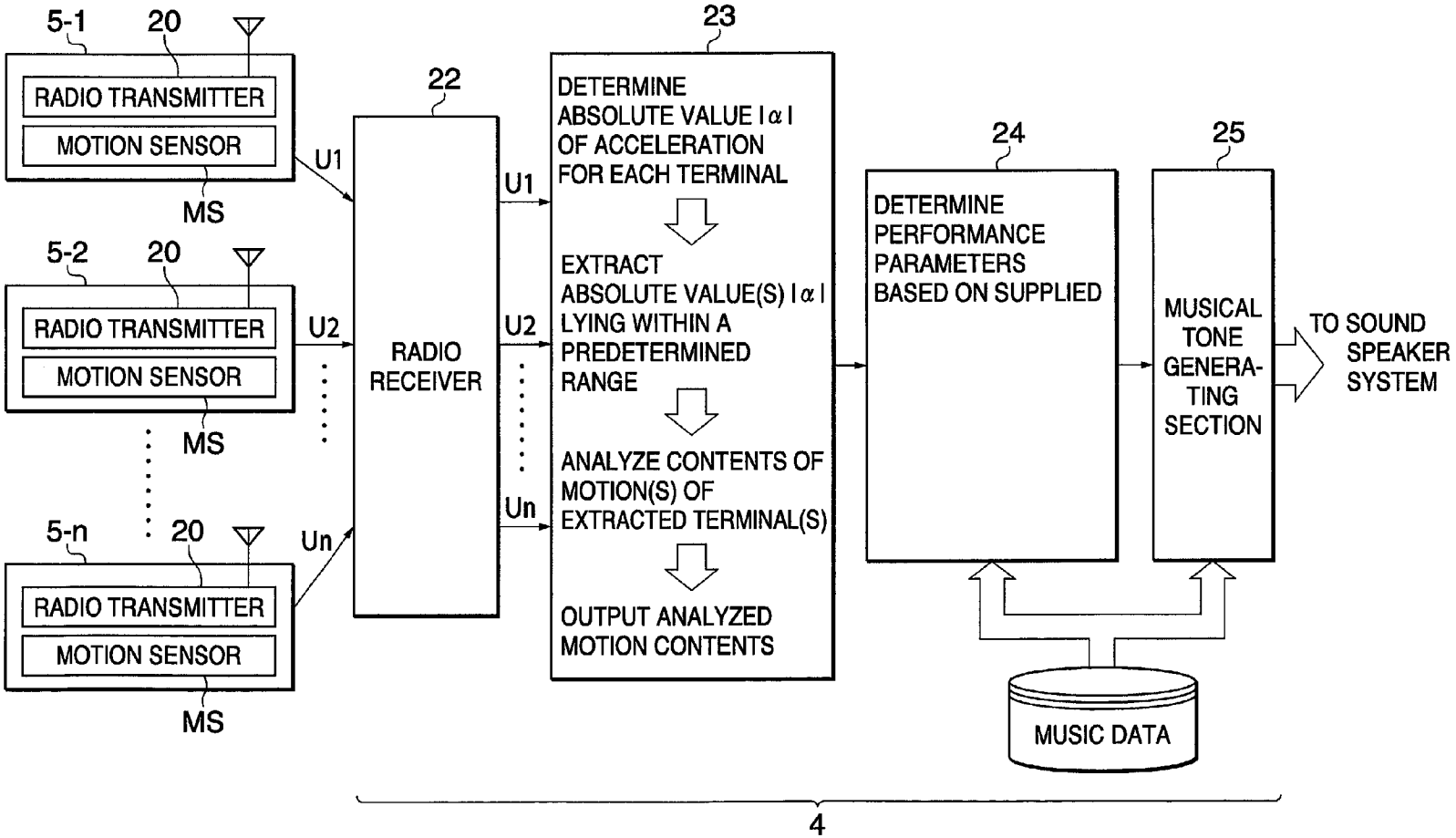
FIG. 6 is a view useful in explaining another example of processing for analysis and extraction and processing for determining parameters according to the musical tone generating system of FIG. 1.

FIG. 6 is a block diagram of another example of the analysis and extraction processing and the parameter determining processing.

As shown in FIG. 6, after extracting only the absolute values $|\alpha|$ of acceleration following a determination as to whether or not the absolute value $|\alpha|$ of acceleration determined based on the detected motion signal from each of the motion detecting terminals 5-1 to **5-*n* lies within a predetermined range, as is the case with the processing of FIG. 5, the information extraction and analysis section 23** may carry out analysis of motions relating to the motion detection results corresponding to the extracted acceleration absolute values $|\alpha|$, so that musical tone generation control is carried out based on the results of analysis.

Specifically, the performance extraction and analysis section 23 compares the accelerations $\alpha x$ and $\alpha y$ and the acceleration $\alpha z$, which are shown by the motion detection results corresponding to the extracted absolute value $|\alpha|$, which have extracted similarly to the processing of FIG. 5. For example, when $\alpha x<\alpha z$ and $\alpha y<\alpha z$ hold, that is, when the z-axis direction acceleration $\alpha z$ is larger than the x- and y-axis direction accelerations $\alpha x$ and $\alpha y$, the performance extraction and analysis section 23 determines that the motion is a "thrust motion" thrusting the motion detecting terminal 5 forward.

Conversely, when the z-axis direction acceleration $\alpha z$ is smaller than the x- and y-axis direction accelerations $\alpha x$ and $\alpha y$, the performance extraction and analysis section 23 determines that the motion is a "cutting motion" cutting through the air with the motion detecting terminal 5. In this case, by further comparing the x- and y-axis direction accelerations $\alpha x$ and $\alpha y$ in value, it is possible to determine whether the direction of the "cutting motion" is "vertical" (x) or "horizontal (y).

Further, in addition to a comparison of the x-, y-, and z-axis direction components with each other, it is possible to compare the magnitudes of the direction components $\alpha x$, $\alpha y$, and $\alpha z$ themselves with predetermined threshold values and determine that the motion is a "combined motion" combining these motions when the values are above the threshold values. For example, if $\alpha z>\alpha x$, $\alpha z>\alpha y$ and $\alpha x>$"threshold value of x-component", it is determined that the movement is a "vertical (x-axis direction) cutting and thrusting motion", while if $\alpha z<\alpha x$, $\alpha z<\alpha y$, $\alpha x>$"threshold value of x-component", and $\alpha y>$"threshold value of y-component", it is determined that the movement is an "obliquely (both x- and y-axis directions) cutting motion". Further, by detecting a phenomenon that the values of the accelerations $\alpha x$, $\alpha y$ in the x and y axis directions are changing relative to each other just like depicting a circular trajectory, it can be determined that the motion is a "turning motion" which turns the motion detecting terminal 5 round and round.

The performance parameter determining section 24 determines the various performance parameters in accordance with these determination outputs. The musical tone generating section 25 controls the performance data based on the set performance parameters and outputs the musical tones played through the sound speaker system 26. For example, it controls the volume of the music data in accordance with the absolute value $|\alpha|$ of the acceleration or the largest of the direction components $\alpha x$, $\alpha y$, and $\alpha z$.

Further, the performance parameter determining section 24 controls the performance parameters in the following way based on the results of the processing for analysis (thrust motion, cutting motion, etc.) of the information extraction and analysis section 23. For example, the tempo is controlled in accordance with the repetition period of the "vertical (x-axis direction) cutting motion". Apart from this, if the "vertical cutting motion" is a quick and small motion, articulation is applied to the reproduced sound, while if it is a slow and large motion, the pitch is lowered. Further, a slur effect is applied to musical tones to be generated when it is determined that the movement is a "horizontal (y-axis direction) cutting motion". When it is determined that the motion is a "thrust motion", a staccato effect is applied in the same timing by shortening the tone generation duration, or a single tone is inserted (a tone of a percussion instrument, a shout or the like) into musical tones to be generated, according to the magnitude of the motion. When it is determined that the motion is a "combined motion" with a "thrust motion", it applies the above-described types of control in combination. Further, when it is determined that the motion is a "turning motion", and its repetition period is long, an enhanced reverberation effect is applied according to the repetition period, and if its repetition period is short, then, control is provided to generate a trill according to the repetition period.

A musical tone signal generated by the musical tone generating section 25 is controlled according to the above described extraction and analysis processing by the information extraction and analysis section 23 and performance parameter determining processing by the performance parameter determining section 24, and the musical tone signal thus controlled is generated by the sound speaker system 26 to thereby carry out music performance.

In the above described musical tone generation processing including the extraction and analysis processing and the parameter determining processing, when musical tone generation control is carried out based on detected motion signals transmitted from a plurality of terminals such as the motion detecting terminals 5-1 to **5-*n*, the information extraction and analysis section 23 extracts only the absolute values $|\alpha|$ of acceleration that match the predetermined condition and perform musical tone generation control based on only the extracted absolute values $|\alpha|$ of acceleration, as described above. Therefore, in the case where a plurality of operators carry out music performance by holding the respective motion detecting terminals 5-1 to 5-*n***, if an operator stops motion due to fatigue or the like or if an operator makes an improper or off-key motion not suited for the performance of the music, the motion of the operator stopping motion or the operator making such improper motion is not reflected upon the musical tone generation control, i. e. the music performance, but only the motions of the other operators making motions lying with a certain range, that is, somewhat suited for the performance of the music are reflected upon the musical tone generation control. It is thus possible to prevent abnormal musical tones from being generated due to improper motion of part of a plurality of operators when music performance is carried out in a manner reflecting motions of the operators. The above-mentioned improper motion differs depending upon performance parameters to be controlled, the contents of a musical composition to be performed, and how the performance parameters should be determined, and therefore optimal extracting conditions should be set depending upon individual music performance conditions.

It should be noted that the present invention is not limited to the above described embodiment, but various modifications and variations are possible as illustrated below.

In the above described embodiment, out of detected motion signals transmitted from the motion detecting terminals 5-1 to **5-*n*, only one or more detected motion signals that match the predetermined condition are extracted by the information extraction and analysis section 23**, and music performance control is carried out based on music data such as MIDI data reflecting only the thus extracted detected motion signal or signals. However, in addition to music performance control based on music data prepared in advance, generation of single tones such as wave sounds, percussion instrument sounds, claps, etc. may be controlled based on the extracted detected motion signals.

Further, in the above embodiment, out of detected motion signals transmitted from the motion detecting terminals 51- to **5-*n***, only detected motion signals that indicate the absolute values $|\alpha|$ of accelerations along the axes lying within the predetermined range are extracted, and musical tone generation control is carried out in a manner reflecting only the extracted detected motion signals. Alternatively, only detected motion signals that meet another condition may be extracted and reflected upon musical tone generation control.

For example, the absolute value $|\alpha|$ of acceleration indicated by each of the detected motion signals from the motion detecting terminals 5-1 to **5-*n*** obtained as in the above embodiment may be compared with a predetermined reference value, and only one of the detected motion signals which is the closest to the reference value may extracted for use in musical tone generation control. Here, by setting the reference value at a value ideal for use in carrying out music performance, out of detected motion signals generated based on motions of a plurality of operators, a detected motion signal that enables control to be performed in a manner being closest to the ideal performance contents can be extracted for use in musical tone generation control.

Not only the detected motion signal corresponding to the absolute value $|\alpha|$ of acceleration closest to the reference value but also detected motion signals corresponding to a predetermined number (for example, three) of absolute values $|\alpha|$ of acceleration closest to the reference value may be extracted for use in musical tone generation control. Here, by setting the reference value at a value ideal for use in carrying out music performance, out of detected motion signals generated based on motions of a plurality of operators, the predetermined number of detected motion signals that enable control to be performed in a manner being close to the ideal performance contents, that is, motions of the predetermined number of operators who have made motions close to the ideal motion can be extracted for use in musical tone generation control.

Further, alternatively to setting a reference value as mentioned above, a detected motion signal that simply indicates the largest absolute value $|\alpha|$ of acceleration (or a predetermined number of detected motion signals that indicate the predetermined number of largest absolute values $|\alpha|$ of acceleration) may be extracted for use in musical tone generation control. Conversely, a detected motion signal that simply indicates the smallest absolute value $|\alpha|$ of acceleration (or a predetermined number of detected motion signals that indicate the predetermined number of smallest absolute values $|\alpha|$ of acceleration) may be extracted for use in musical tone generation control.

Although in the above embodiment, out of the detected motion signals from the motion detecting terminals 5-1 to **5-*n*, detected motion signals for which the absolute values $|\alpha|$ of acceleration satisfying the predetermined condition are determined are extracted for use in musical tone generation control, the detected motion signals from the motion detecting terminals 5-1 to 5-*n*** may be subjected to analysis of one or more parameter values other than the absolute value $|\alpha|$ of acceleration, and detected motion signals for which the results of analysis satisfy a predetermined condition may be extracted.

Figure 7:
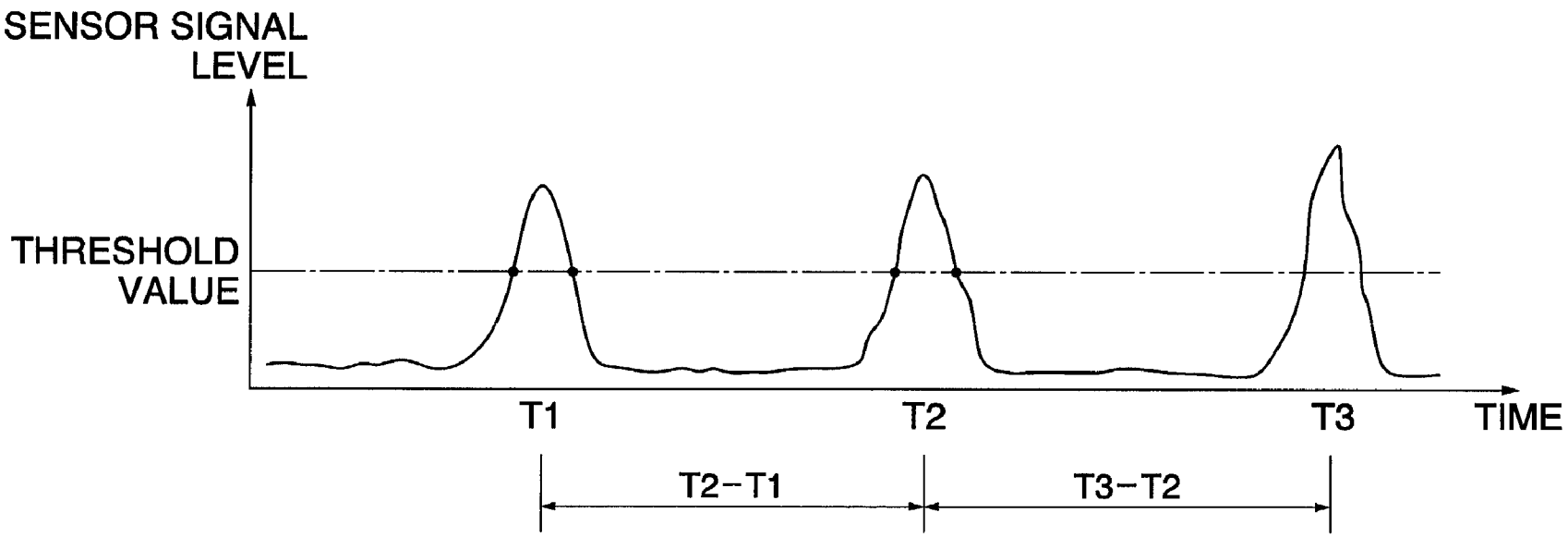
FIG. 7 is a graph useful in explaining processing for extraction and analysis according to a variation of the embodiment.

For example, out of the detected motion signals from the motion detecting terminals 5-1 to **5-*n*, detected motion signals which indicate signal waveform periods lying within a predetermined range may be extracted for use in musical tone generation control. In other words, out of sensor output signal waveforms along a predetermined axis (for example, the x axis) from the motion sensors MS being the detected motion signals from the motion detecting terminals 5-1 to 5-*n*, only sensor output signalwaveforms having periods lying within a predetermined range may be extracted, and using the periods of the extracted sensor output signal waveforms, timing of generation of a single sound such as wave sound may be controlled. More specifically, assuming that an output signal from a certain motion sensor MS out of the motion sensors MS of the motion detecting terminals 5-1 to 5-*n* changes in level as shown in FIG. 7, the level of the output signal is compared with a predetermined threshold value, and time intervals between time points T1, T2 and T3 at which the output signal level exceeds the threshold value are detected as periods. The time points T1, T2 and T3 indicate timing in which the operator of the associated motion detecting terminal makes large motions, and the detected time intervals thus indicate the periods of timing in which the operator makes large motions. When these periods (T2–T1) and (T3–T2**) are within a predetermined range, the period of this sensor output signal waveform is used for musical tone generation control. The manner of using the thus extracted sensor output signal waveform period in musical tone generation control may include a manner comprising determining an average value of periods of one or more extracted sensor output signal waveforms, and generating a single tone such as wave sound and percussion instrument sound every determined average period. The above-mentioned predetermined range for period extraction may be appropriately determined depending upon the contents of musical tone generation control. However, to generate wave sound as mentioned above, it is preferable to set the predetermined range to a relatively long period such as a range of 4 to 8 seconds. Further, to control the tempo of music performance based on MIDI data or the like according to the sensor output waveform period, it is preferable to set the predetermined range to a range of 0.5 to 1 second, for example.

Figure 8:
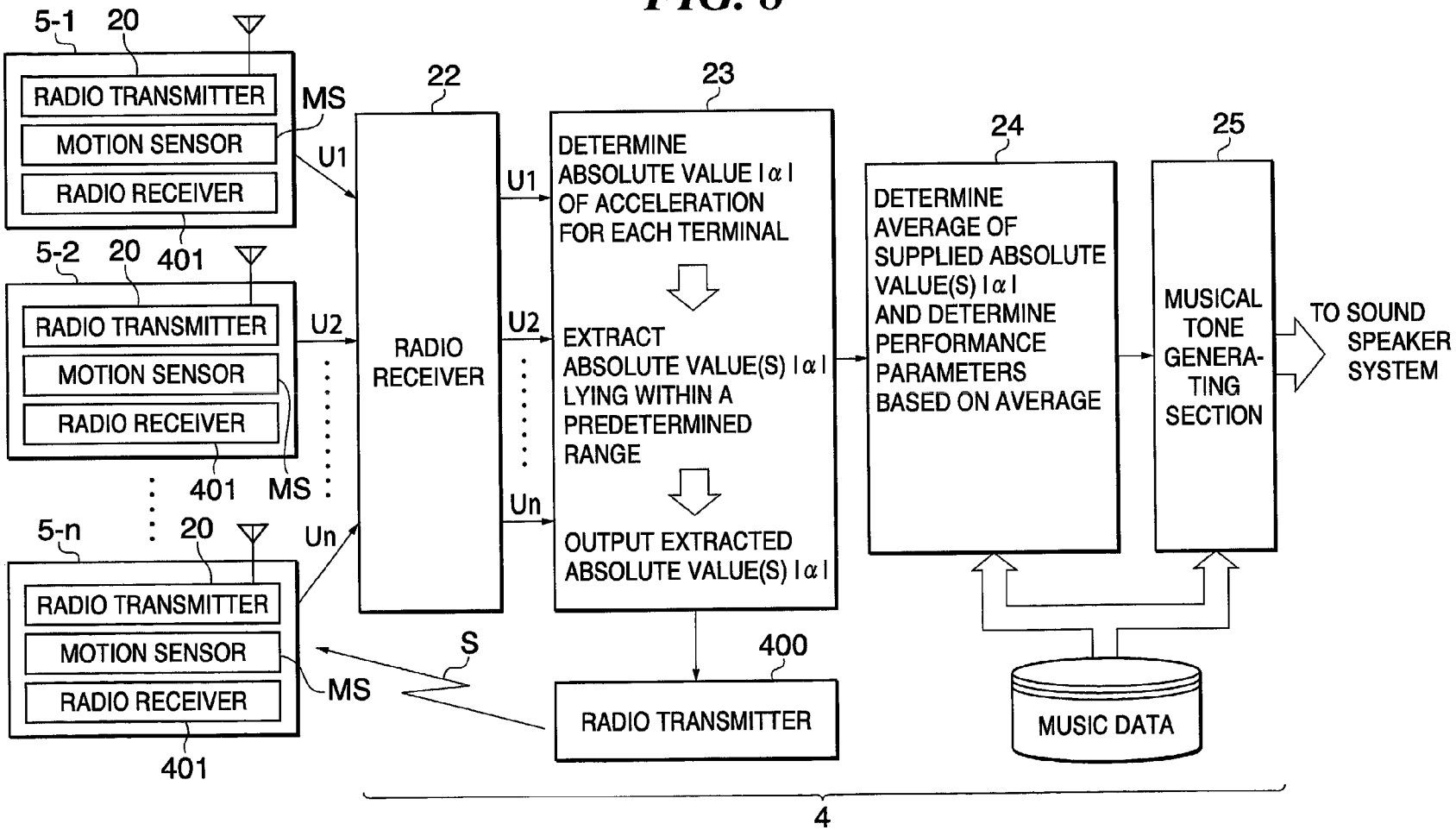
FIG. 8 is a view useful in explaining another example of processing for extraction and analysis and processing for determining parameters according to another variation of the embodiment.

Further, although in the above embodiment and variations, out of the detected motion signals transmitted from the motion detecting terminals 5-1 to **5-*n*, only one or more detected motion signals that match the predetermined condition are extracted by the information extraction and analysis section 23 and musical tone generation control is carried out based on music data such as MIDI data in a manner reflecting only the extracted detected motion signal(s), use information indicating that the motions of motion detecting terminals that transmitted the currently extracted detected motion signals are currently used in the musical tone generation control may be transmitted to these terminals during the musical tone generation control, as shown in FIG. 8**.

As shown in FIG. 8, the musical tone generating system according to this variation is different from the musical tone generating system 3 according to the above described embodiment in that a radio transmitter 400 is provided in the musical tone generating apparatus 4, and a radio receiver 401 is provided in each of the motion detecting terminals 5-1 to **5-*n*. The radio transmitter 400 provided in the musical tone generating apparatus 4 specifies the transmission sources of detected motions signals corresponding to absolute values $|\alpha|$ of acceleration extracted by the information extraction and analysis section 23 in the above described embodiment, and radio transmits use information S containing ID numbers for identifying the motion detecting terminals as the transmission sources. As mentioned above, the motion detecting terminals 5-1 to 5-*n* each have the radio receiver 401 that receives the use information D radio transmitted from the radio transmitter 400 of the musical tone generating apparatus 4, and determine whether the use information S contains an ID number representing the motion detecting terminal. If the use information S contains an ID number representing the motion detecting terminal, the motion detecting terminal judges that its own detected motion signal transmitted from the terminal is used, and then carries out processing for notifying the operator to that effect, by turning on the display unit T3 (see FIG. 2) to emit light, for example. By this processing, if a plurality of operators carry the respective motion detecting terminals 5-1 to 5-*n*, they can recognize whether the detected motions from the motion detecting terminals carried by them are used or not by viewing the lighting state of the display unit T3**.

In the above example, the display unit T3 is caused to emit light to notify the operator that the detected motion of the motion detecting terminal carried by him or her is used in the musical tone generation control. Alternatively, a vibration motor may be installed in each of the motion detecting terminals 5-1 to **5-*n* and when it is determined that the detected motion of the motion detecting terminal carried by the operator, from the use information S radio transmitted from the musical tone generating apparatus 4**, the vibration motor may be driven to notify the operator to that effect. Moreover, various other notifying methods may be used, such as a method utilizing the visual sense, tactile sense or auditory sense.

Although in the above example, the radio transmitter 400 of the musical tone generating apparatus 4 transmits the use information S containing ID numbers for identifying specified transmission sources to all of the motion detecting terminals 5-1 to **5-*n*, and each of the motion detecting terminals 5-1 to 5-*n* determines whether or not the detected motion of the motion detecting terminal is used, if there is provided a radio transmission and reception function that enables the musical tone generating apparatus 4 to carry out individual radio transmissions to the respective motion detecting terminals 5-1 to 5-*n*, it may be so arranged that the radio transmitter 400 transmits the use information S only to motion detecting terminal(s) as transmission source(s) specified by the information extraction and analysis section 23**.

Further, although in the above embodiment, musical tone generation control is carried out using detected motion signals acquired according to the motions of the operators by the motion sensors MS formed of three-dimensional sensors or the like, in place of such motion sensors MS, it is also possible to use a plurality of human body state sensors for detecting physiological body states such as the pulse, body temperature, skin resistance, and brain waves, breathing, eye movement, and other human body state information and to cause the musical tone generating apparatus 4 to control the generation of musical tones based on human body state signals detected by the human body state sensors. In this case as well, only human body state signals indicative of human body states detected by the human body state sensor are each in a predetermined range (for example, a normal general number of pulses in the case of the pulse) are extracted, so that musical tone generation control is carried out based on the extracted human body state signals.

Although in the above embodiment, detected motion signals from the motion sensors installed in the motion detecting terminals 5-1 to **5-*n* are radio transmitted to the musical tone generating apparatus 4, this is not limitative, but the motion detecting terminals 5-1 to 5-*n* and the musical tone generating apparatus 4 may be connected by signal cables or the like and detected motion signals from the motion sensors MS are transmitted through the signal cables or the like from the motion detecting terminals 5-1 to 5-*n* to the musical tone generating apparatus 4**.

It is also possible to provide the user(s) with a CD-ROM, floppy disk, or various other storage media storing a program for causing a computer to realize the above described extraction and analysis processing and processing determining the performance parameters, or the user(s) may be provided with the program through the Internet or other transmission media.

While the invention has been described with reference to specific embodiments chosen for purpose of illustration, it should be apparent that numerous variations could be made thereto by those skilled in the art without departing from the basic concept and scope of the invention.

What is claimed is:

1. A musical tone control system comprising:

a plurality of motion detecting devices capable of being carried by a plurality of persons, said motion detecting devices detecting motions of the persons carrying the devices, and transmitting detected motion signals corresponding to the detected motions of the persons together with device identification signals;

a receiver device that receives the detected motion signals transmitted from said plurality of motion detecting devices and corresponding to the detected motions of the persons;

a memory provided on the receiver device side in which a predetermined extracting condition is stored; and a control device provided on the receiver device side, said control device determining whether the detected motion signals received by said receiver device satisfy the predetermined extracting condition, and extracting at least one detected motion signal determined to satisfy the predetermined extracting condition from the detected motion signals received by said receiver device, wherein, by interpreting said device identification signals, said control device discriminates from which of said plurality of motion detecting devices the at least one detected motion signal extracted from the detected motion signals received by said receiver device has been transmitted, and wherein said control device controls musical tones to be generated, based on an average value of each of the extracted at least one detected motion signal and results of the discrimination.

2. A musical tone control system as claimed in claim 1, wherein said control device extracts at least one detected motion signal indicative of at least one motion lying within a predetermined range of motions from the detected motion signals received by said receiver device.

3. A musical tone control system as claimed in claim 1, wherein said control device extracts a predetermined number of detected motion signals indicative of detected motions close to a predetermined motion in order of closeness from the detected motion signals received by said receiver device.

4. A musical tone control system as claimed in claim 1, further comprising a transmitter device that transmits information for notifying that the at least one detected motion signal has been extracted, to at least one corresponding one of said motion detecting devices.

5. A musical tone control system comprising:

a plurality of human body state detecting devices capable of being carried by persons, said human body state detecting devices detecting physiological body states exclusive of movement of human limbs of the persons carrying the devices, and transmitting detected human body state signals corresponding to the detected physiological body states of the persons together with device identification signals;

a receiver device that receives the detected human body state signals transmitted from said plurality of human body state detecting devices and corresponding to the detected physiological body states of the persons;

a memory provided on the receiver device side in which a predetermined extracting condition is stored; and a control device provided on the receiver device side, said control device determining whether the detected human body state signals received by said receiver device satisfy the predetermined extracting condition, and extracting at least one detected human body state signal determined to satisfy the predetermined extracting condition from the detected human body state signals received by said receiver device, wherein, by interpreting said device identification signals, said control device discriminates from which of said plurality of human body state detecting devices the at least one detected human body state signal extracted from the detected human body state signals received by said receiver device has been transmitted, and wherein said control device controls musical tones to be generated, based on an average value of each of the extracted at least one detected human body state signal and results of the discrimination.

6. A musical tone control apparatus for use with a plurality of motion detectors transmitting a plurality of detected motion signals, the apparatus comprising:

a receiver device that receives the plurality of detected motion signals corresponding to motions of a plurality of persons; and a control device that extracts at least one detected motion signal indicative of at least one motion lying within a predetermined range of motions and a predetermined number of detected motion signals indicative of detected motions close to a predetermined motion in order of closeness from the detected motion signals received by said receiver device, discriminates which of the plurality of persons, a motion of which the at least one detected motion signal extracted from the detected motion signals received by said receiver device and the predetermined number of detected motion signals extracted from the detected motion signals received by said receiver device correspond to, and controls musical tones to be generated, based on the extracted at least one detected motion signal or the extracted predetermined number of detected motion signals and results of the discrimination.

7. A musical tone control system comprising:

a plurality of human body state detecting devices capable of being carried by persons, said human body state detecting devices detecting physiological body states selected from the group consisting of pulse, body temperature, skin resistance, brain waves, breathing, eye movement of the persons carrying said devices, said human body state detecting devices transmitting detected human body state signals corresponding to the detected physiological body states of the persons together with device identification signals;

a receiver device that receives the detected human body state signals transmitted from said plurality of human body state detecting devices and corresponding to the detected physiological body states of the persons;

a memory provided on the receiver device side in which a predetermined extracting condition is stored; and a control device provided on the receiver device side, said control device determining whether the detected human body state signals received by said receiver device satisfy the predetermined extracting condition, and extracting at least one detected human body state signal determined to satisfy the predetermined extracting condition from the detected human body state signals received by said receiver device, wherein, by interpreting said device identification signals, said control device discriminates from which of said plurality of human body state detecting devices which the at least one detected human body state signal extracted from the detected human body state signals received by said receiver device has been transmitted, and wherein said control device controls musical tones to be generated, based on an average value of each of the extracted at least one detected human body state signal and results of the discrimination.

8. A musical tone control system comprising:

a plurality of human body state detecting devices capable of being carried by persons, said human body state detecting devices detecting physiological body states selected from the group consisting of pulse, body temperature, skin resistance, brain waves, breathing, eye movement and other human body state information of the persons carrying said devices, said human body state detecting devices transmitting detected human body state signals corresponding to the detected physiological body states of the persons together with device identification signals;

a receiver device that receives the detected human body state signals transmitted from said plurality of human body state detecting devices and corresponding to the detected physiological body states of the persons;

a memory provided on the receiver device side in which predetermined extracting condition is stored; and a control device provided on the receiver device side, said control device determining whether the detected human body state signals received by said receiver device satisfy the predetermined extracting condition, and extracting at least one detected human body state signal determined to satisfy the predetermined extracting condition from the detected human body state signals received by said receiver device, wherein, by interpreting said device identification signals, said control device discriminates from which of said plurality of human body state detecting devices the at least one detected human body state signal extracted from the detected human body state signals received by said receiver device has been transmitted, and controls musical tones to be generated, based on an average value of each of the extracted at least one detected human body state signal and results of the discrimination.

9. A musical tone control system comprising:

a plurality of motion detecting devices capable of being carried by a plurality of persons, said motion detecting devices detecting motions of the persons carrying the devices, and transmitting detected motion signals corresponding to the detected motions of the persons together with device identification signals;

a receiver device that receives the detected motion signals transmitted from said plurality of motion detecting devices and corresponding to the detected motions of the persons; and a control device that extracts at least one detected motion signal satisfying a predetermined condition from the detected motion signals received by said receiver device, discriminates which of said plurality of motion detecting devices by interpreting said device identification signals, from which the at least one detected motion signal extracted from the detected motion signals received by said receiver device has been transmitted, and controls musical tones to be generated, based on the extracted at least one detected motion signal and results of the discrimination, wherein said control device extracts a predetermined number of detected motion signals indicative of detected motions close to a predetermined motion in order of closeness from the detected motion signals received by said receiver device.

10. A musical tone generating apparatus comprising:

a receiver device that receives a plurality of detected motion signals together with device identification signals, transmitted from a plurality of motion detecting devices capable of being carried by a plurality of persons and detecting motions of the persons carrying the motion detecting devices, the detected motion signals corresponding to the detected motions of the persons; and a control device that extracts at least one detected motion signal indicative of at least one motion lying within a predetermined range of motions and a predetermined number of detected motion signals indicative of detected motions close to a predetermined motion in order of closeness from the detected motion signals received by said receiver device, discriminates which of the plurality of motion detecting devices by interpreting the device identification signals, from which the at least one detected motion signal extracted from the detected motion signals received by said receiver device and the predetermined number of detected motion signals extracted from the detected motion signals received by said receiver device have been transmitted, and controls musical tones to be generated, based on the extracted at least one detected motion signal or the extracted predetermined number of detected motion signals and results of the discrimination.

11. A musical tone control system according to claim 1, wherein each of the detected motion signals is determined as satisfying the predetermined extracting condition when the detected motion signal has a value falling within a predetermined range.

12. A musical tone control system according to claim 1, wherein said control device calculates the average value of the extracted at least one detected motion signal.

13. A musical tone control system comprising:

a plurality of motion detecting devices capable of being carried by a plurality of persons, said motion detecting devices detecting motions of the persons carrying the devices, and transmitting detected motion signals corresponding to the detected motions of the persons together with device identification signals;

a receiver device that receives the detected motion signals transmitted from said plurality of motion detecting devices and corresponding to the detected motions of the persons;

a memory provided on the receiver device side in which a predetermined extracting condition is stored; and a control device provided on the receiver device side, said control device determining whether the detected motion signals received by said receiver device satisfy the predetermined extracting condition, and extracting at least one detected motion signal determined to satisfy the predetermined extracting condition from the detected motion signals received by said receiver device, wherein, by interpreting said device identification signals, said control device discriminates from which of said plurality of motion detecting devices the at least one detected motion signal extracted from the detected motion signals received by said receiver device has been transmitted, and wherein said control device carries out analysis of motions relating to results of the motion detection corresponding to the extracted at least one detected motion signal, and controls musical tones to be generated, based on results of the analysis and results of the discrimination.

14. A musical tone control system according to claim 13, wherein said control device carries out the analysis of motions only relating to results of the motion detection by at least one discriminated motion detecting device from which the at least one detected motion signal extracted from the detected motion signals has been transmitted.

15. A musical tone control system according to claim 5, wherein each of the detected motion signals is determined as satisfying the predetermined extracting condition when the detected motion signal has a value falling within a predetermined range.

16. A musical tone control system according to claim 7, wherein each of the detected motion signals is determined as satisfying the predetermined extracting condition when the detected motion signal has a value falling within a predetermined range.

17. A musical tone control system according to claim 8, wherein each of the detected motion signals is determined as satisfying the predetermined extracting condition when the detected motion signal has a value falling within a predetermined range.

18. A musical tone control system according to claim 5, wherein said control device calculates the average value of the extracted at least one detected motion signal.

19. A musical tone control system according to claim 7, wherein said control device calculates the average value of the extracted at least one detected motion signal.

20. A musical tone control system according to claim 8, wherein said control device calculates the average value of the extracted at least one detected motion signal.

* * * * *